US005421741A

United States Patent [19]

David et al.

[11] Patent Number: 5,421,741

[45] Date of Patent: Jun. 6, 1995

[54] ELECTRICAL CONNECTION ASSEMBLY

[75] Inventors: James J. David, Mechanicsburg; Steven K. Forman, Harrisburg; Ralph A. Papa, Mechanicsburg, all of Pa.

[73] Assignees: Berg Technology, Inc., Reno, Nev.; Connector Systems Technology, N.V., Curacao, Netherlands

[21] Appl. No.: 109,826

[22] Filed: Aug. 20, 1993

[51] Int. Cl.[6] ..... H01R 4/24

[52] U.S. Cl. ..... 439/405; 439/77

[58] Field of Search ..... 439/404, 405, 77

[56] References Cited

U.S. PATENT DOCUMENTS

| | | | |
|---|---|---|---|
| 4,099,822 | 7/1978 | Carlisle et al. | 439/405 |
| 4,236,779 | 12/1980 | Tang . | |
| 4,387,509 | 6/1983 | Dechelette . | |
| 4,392,701 | 7/1983 | Weidler | 439/405 |
| 4,416,501 | 11/1983 | Fusselman et al. . | |
| 4,820,192 | 4/1989 | Denkmann et al. . | |
| 4,934,946 | 6/1990 | Ordway | 439/77 |
| 5,092,792 | 3/1992 | Nilsson . | |

OTHER PUBLICATIONS

DuPont Connector Systems, Berg Electronics, Product Catalog A, pp. 23–58 and 23–59.

*Primary Examiner*—Steven C. Bishop

*Attorney, Agent, or Firm*—Woodcock Washburn Kurtz Mackiewicz & Norris

[57] ABSTRACT

An electrical connection assembly for providing a variety of input/output connections between electrical conductors and connectors. An electrical path is established between insulation displacement contacts positioned on a printed circuit board and one or more connectors connected to the board. The insulation displacement contacts are pre-arranged on the board in accordance with the board circuitry to provide a desired input/output arrangement. The conductors are terminated at the insulation displacement contacts on the board in a simple manner without a complex assembly and pre-arrangement of the conductor wires.

17 Claims, 2 Drawing Sheets

ELECTRICAL CONNECTION ASSEMBLY

FIELD OF THE INVENTION

The present invention relates generally to electrical connection assemblies. More particularly, this invention relates to an electrical connection assembly which provides for electrical interconnection of a cable carrying a plurality of electrical conductors to at least one electrical connector.

BACKGROUND OF THE INVENTION

The development of tight-centered high density electrical connectors has made it possible to densely pack a high number of electrical contacts into a small connector housing. These connectors are connected to a printed circuit board such that electrical connection is made between the connector and the board circuitry for carrying out a variety of functions in a known manner.

Where it is desirable to provide an input/output connection assembly wherein the relatively small electrical connector must be interconnected to a plurality of electrical conductors carried in a shielded cable, the conductors of the cable must be terminated at the printed circuit board. The board provides the translation of the signals carried by the conductor wires such that proper alignment and electrical interconnection of the conductors and the electrical connector is established.

Direct soldering of the electrical conductors to the board is complex and time consuming, resulting in excessive manufacturing costs. A complex pre-arrangement of the conductors is necessary to ensure that the conductors are properly aligned on the printed circuit board. Also, secondary operations, such as fluxing of the solder, are necessary to ensure that a durable connection is made, thus increasing the cost and complexity of the assembly.

Therefore, there is a need for an electrical connection assembly which provides for low-cost, reliable termination of a plurality of conductors to a printed circuit board such that the conductors are electrically interconnected to an electrical connector attached to the printed circuit board. The present invention provides an electrical connection assembly which satisfies this need.

SUMMARY OF THE INVENTION

An electrical connection assembly for connecting a plurality of electrical conductors comprises a substrate having a plurality of traces arranged thereon and a plurality of insulation displacement contacts disposed in the substrate. At least one electrical connector is connected to the substrate such that the circuitry is arranged to provide a path for a flow of electricity between the insulation displacement contacts and the electrical connector. Termination of the electrical conductors at the insulation displacement contacts provides for electrical interconnection between the conductors and the connector.

DETAILED DESCRIPTION OF THE PREFERRED EMBODIMENTS

Figure 1:
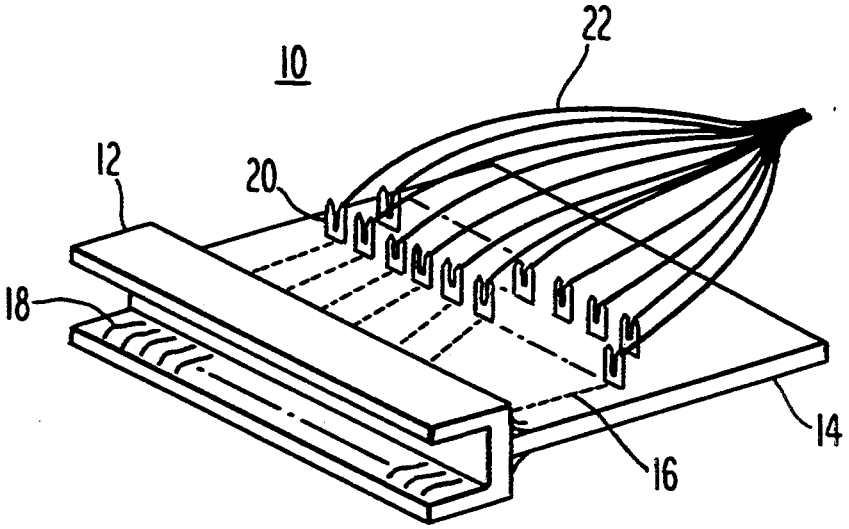
FIG. 1 shows an electrical connection assembly in accordance with the present invention.

FIG. 1 shows an electrical connection assembly 10 in accordance with the present invention. Electrical connector 12 is connected to substrate 14 by any known method such as soldering, welding, press fitting or riveting. Connector 12 is connected to substrate 14 such that the traces 16 forming the circuitry on substrate 14 are connected to the electrical contacts 18 of connector 12 in a known manner. In one embodiment of the present invention, substrate 14 with traces 16 thereon comprise a printed circuit board. In another embodiment substrate 14 and traces 16 comprise a flex circuit and in yet another embodiment substrate 14 and traces 16 comprise a semi-rigid flex circuit. Connector 12 may be, for example, a tight-centered connector such as a 0.025 inch centerline connector, a 2 mm connector or a 0.050 inch centerline connector (the specified dimension generally referring to the spacing between the centerline of adjacent contacts in the connector). However, the present invention is not intended be limited to these examples and a wide variety of substrates and connectors are applicable for use in the present invention.

Insulation displacement contacts 20 are disposed in substrate 14 by any known manner such as soldering or press-fitting. Insulation displacement contacts 20 are disposed in substrate 14 such that electrical contact is made with traces 16. Electrical conductor wires 22 are terminated at insulation displacement contacts 20 to make electrical connection between the conductor and the insulation displacement contact. Accordingly, electrical interconnection is established between conductor 22 and electrical contacts 18 of connector 12 with the traces on the substrate 14 accounting for the electrical interconnection.

Figure 2:
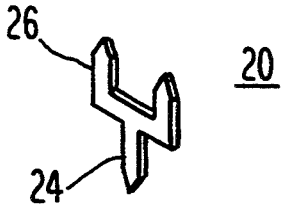
FIG. 2 shows an insulation displacement contact in accordance with the present invention.

An insulation displacement contact 20 is shown in FIG. 2. Stem 24 is inserted into the substrate 14 for establishing contact with one of the traces on the substrate. Conductor wires 22 comprising a conductor with a layer of insulation, such as plastic, wrapped around the conductor are positioned on insulation displacement contacts 20. A pair of upwardly extending tines 26 receive a conductor wire so as to displace the insulation around the conductor, make electrical connection, and mechanically hold the wire in a fixed position.

The insulation displacement contacts are disposed in the substrate and pre-arranged in alignment with the traces of the substrate such that the circuitry provides the translation necessary for interconnecting the conductors and the electrical connector in the desired manner to achieve a desired function. Thus, arrangement of the conductor wires is simplified and the conductor wires are terminated at the substrate in a cost effective and less timely manner. Moreover, since the insulation displacement contacts are disposed in the substrate in any preselected manner and the circuitry can be designed in a specified manner, a wide variety of electrical conductor arrangements may be connected to a wide variety of connectors to provide an input/output electrical connection assembly which may be easily assembled for a large number of applications.

Figure 3:
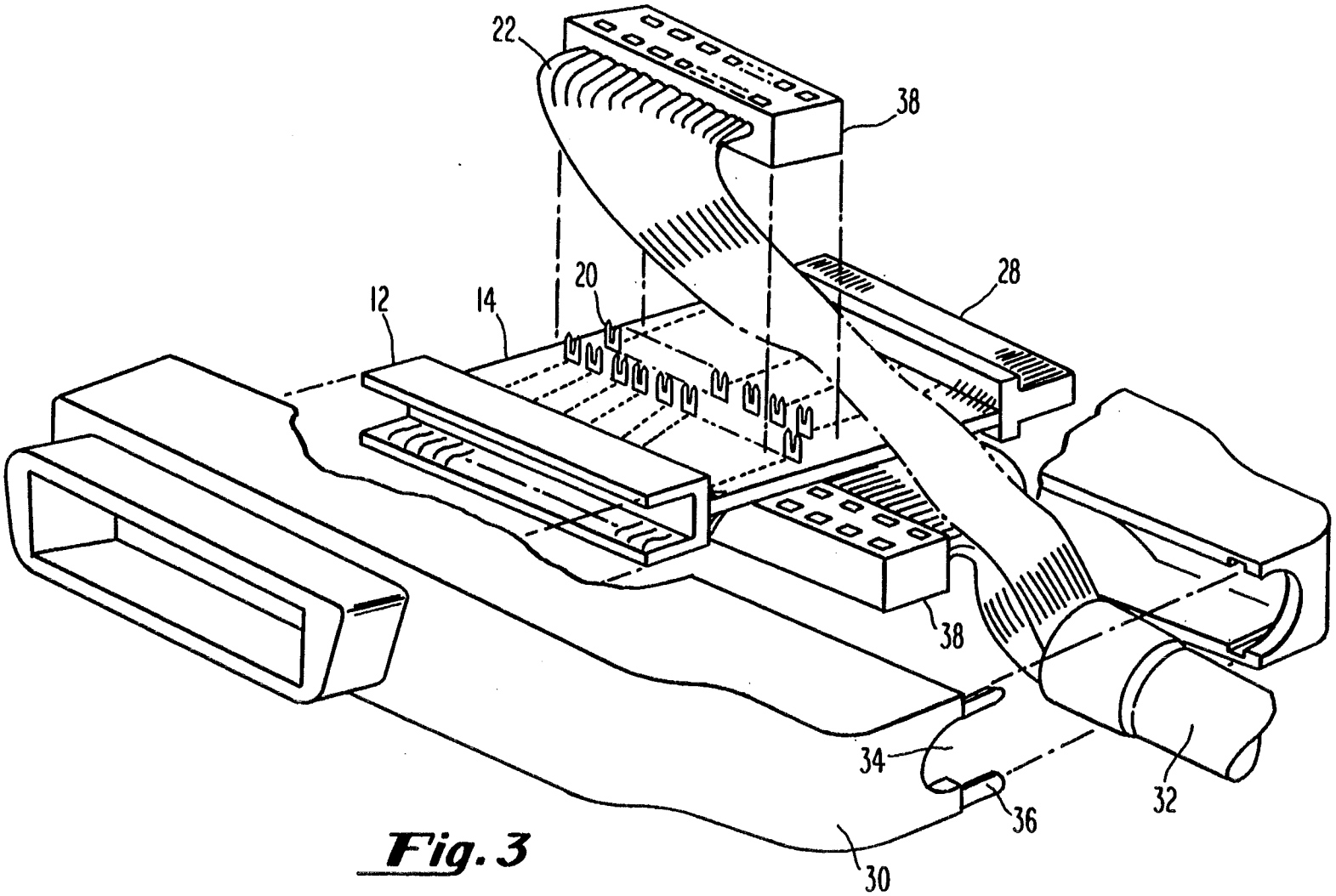
FIG. 3 shows an isometric view of a preferred embodiment of an electrical connection assembly in accordance with the present invention.

FIG. 3 shows an electrical connection assembly in accordance with one embodiment of the present invention. Electrical connector 12 is connected to printed circuit board 14 and a second electrical connector 28 is connected to another end of board 14. The board and the electrical connectors are disposed in housing 30.

The housing comprises a conducting material, the preferred material being zinc. In another embodiment of the present invention, the housing comprises a dielectric material. Housing 30 comprises two halves which are connected together to enclose the printed circuit board and connector assembly.

A plurality of conductors 22 are wrapped and carried in cable 32. As is commonly known, cable 32 comprises a layer of a flexible conductive shield wrapped around the electrical conductors and a second layer of insulation wrapped around the shield. In a preferred embodiment the flexible conductive shield is a braided metal. Cable 32 is inserted in hole 34 in the housing such that when the two halves of the housing are connected the conductive shield is electrically connected to the housing in the manner shown in the commonly assigned, U.S. Pat. No. 4,416,501 —Fusselman et al., which is herein incorporated by reference. The U-shaped penetration device 36 pierces the insulation layer around the cable to make an electrical contact with the shield. Thus, the cable is electrically connected to the housing such that EMI/RMI distortion effects are minimized in a known manner.

The conductor wires 22 extend through the end of cable 32 into housing 30 for termination to the insulation displacement contacts on the printed circuit board. The conductor wires may be arranged in a variety of forms such as a twist-n-flat construction, twisted pairs, or discrete wires, and the construction may be laminated as is known in the art. However, the present invention is not intended to be limited in this manner and a wide variety of wire arrangements are within the scope of this invention. Since the insulation displacement contacts are disposed in the printed circuit board in the desired manner for a specified function, arrangement of the conductor wires is simplified.

Conductor wires 22 are loaded into wire fixture termination block 38 for use in terminating the wires to the insulation displacement contacts. Termination block 38 captures the conductor wires and holds them in a known manner for ease of engagement with insulation displacement contacts 20. As shown in the embodiment of FIG. 3, conductor wires may be terminated to the top and bottom surfaces of the printed circuit board.

Although particular embodiments of the present invention have been described and illustrated herein, it is recognized that modifications and variations may readily occur to those skilled in the art. Consequently, it is intended that the claims be intended to cover such modifications and equivalents.

What is claimed is:

1. An electrical connection assembly for connecting a terminating portion of a cable having a plurality of electrical conductors, comprising:

a substrate having a plurality of traces arranged thereon;

a plurality of insulation displacement contacts disposed in said substrate, said insulation displacement contacts in electrical connection with said traces; and at least one electrical connector connected to said substrate, said traces arranged on said substrate to provide a path for a flow of electricity between said insulation displacement contacts and said electrical connector, the displacement contacts configured so that the plurality of electrical conductors of the terminating portion of the cable are electrically connected to said traces when disposed in the displacement contacts thereby electrically connecting the plurality of electrical conductors of the terminating portion of the cable to the electrical connector.

2. The assembly of claim 1, wherein said substrate and said traces comprise a printed circuit board.

3. The assembly of claim 1, wherein said substrate and said traces comprise a flex circuit.

4. The assembly of claim 1, wherein said substrate and said traces comprise a semi-rigid flex circuit.

5. The assembly of claim 2, wherein said connector is a 0.025 inch centerline connector.

6. The assembly of claim 2, wherein said connector is a 2 mm connector.

7. The assembly of claim 2, wherein said connector is a 0.050 inch centerline connector.

8. The assembly of claim 2, wherein said insulation displacement contacts are connected to said board by soldering.

9. The assembly of claim 2, said cable comprising a first layer of a flexible conductive shield wrapped around said plurality of electrical conductors and a second layer of insulation wrapped around said shield.

10. The assembly of claim 9, wherein said conductive shield comprises braided metal.

11. The assembly of claim 9, further comprising a housing, said board and said at least one electrical connector disposed in said housing, said housing comprising a conducting material and having a hole therein, said cable passing through said hole and carrying said conductors to said board for termination at said insulation displacement contacts.

12. The assembly of claim 11, said assembly further comprising a wire fixture termination block, said conductors loaded into said block such that said block connects said conductors to said insulation displacement contacts.

13. The assembly of claim 2, wherein said assembly comprises two electrical connectors connected to said board.

14. A method for connecting a terminating portion of a cable having a plurality of electrical conductors to a substrate carrying circuit elements, comprising the steps of:

providing a substrate having a plurality of traces arranged thereon;

affixing a plurality of insulation displacement contacts on said substrate in contact with said traces, said contacts positioned on said substrate in predetermined arrangement;

connecting at least one electrical connector to said substrate, said traces being in electrical connection with said connector; and connecting said conductors of the terminating portion of the cable to said insulation displacement contacts to establish electrical interconnection between said conductors of the terminating portion of the cable and said connector.

15. The method of claim 14, said substrate having a first and second side, wherein said affixing step is characterized in that said insulation displacement contacts are affixed to said first and second side of said substrate.

16. The method of claim 14, wherein said substrate and said traces comprise a printed circuit board.

17. The method of claim 14, further comprising the steps of loading said conductors into a wire fixture termination block and affixing said block to said substrate to connect said conductors to said insulation displacement contacts.

* * * * *